United States Patent [19]

Sheppard

[11] Patent Number: 4,556,859

[45] Date of Patent: Dec. 3, 1985

[54] METHOD AND STRUCTURE OF INDIVIDUALLY SHIELDED, RELAY, PICKUP AND HOLDING COILS, TO REDUCE THE EFFECTS OF EXTERNAL AND INTERNAL TRANSIENTS

[76] Inventor: Howard H. Sheppard, 7430 Sprague St., Philadelphia, Pa. 19119

[21] Appl. No.: 417,239

[22] Filed: Sep. 13, 1982

[51] Int. Cl.[4] ..... H01F 7/00

[52] U.S. Cl. ..... 335/301; 335/268

[58] Field of Search ..... 335/256, 266, 268, 278, 335/282, 301

[56] References Cited

U.S. PATENT DOCUMENTS 3,013,102 12/1961 Doll ..... 335/301 X 3,576,473 4/1971 Genbauffe ..... 335/256

FOREIGN PATENT DOCUMENTS 204643 11/1956 Australia ..... 335/301

*Primary Examiner*—George Harris

*Attorney, Agent, or Firm*—Michael F. Petock

[57] ABSTRACT

A method of increasing immunity to externally generated transients and reducing the magnitude of internally generated transients in a relay uses a flat or pancake holding coil mounted axially from the operating (pickup) coil. Both operating and holding coils may be individually provided with conductive shields juxtaposed to the flat surface of each such coil and partially covering their respective peripheries.

12 Claims, 5 Drawing Figures

METHOD AND STRUCTURE OF INDIVIDUALLY SHIELDED, RELAY, PICKUP AND HOLDING COILS, TO REDUCE THE EFFECTS OF EXTERNAL AND INTERNAL TRANSIENTS

BACKGROUND OF THE INVENTION

The present invention is directed to a method of reducing electrical transients in a relay coil and the structure of such a relay coil for providing the reduction in electrical transients. More particularly, the present invention is directed to the use of a flat or pancake shaped holding coil mounted in a position axially spaced from the operating coil and provided with a conductive shield in close proximity thereto to reduce electrical transients. The present invention is directed to the relay art, and particularly to the relay art for protective electrical relays. In other words, the present invention is particularly directed to applications wherein relays having armatures are utilized as protective relays to protect electrical circuits from overload, although the present invention may be utilized in relays for other applications. Particularly, the present invention is particularly adapted for use in direct current (DC) relays.

In a typical DC relay, an operating coil and a holding coil are provided. A relatively high value of operating current is required to close the armature of a DC relay. Only a small fraction of this value, sometimes referred to as a holding current, is required to maintain the armature in the operated position. If the operating current is maintained to hold the armature in the operated position, there may be considerable overheating and possible burnout of the operating coil. To prevent such adverse results, it has been customary to automatically switch a holding coil in series with the operating coil. The holding coil has a large number of turns of fine gauge wire which gives it a high resistance. The high resistance of the series connected coils reduces the holding current to a low value. However, the large number of turns of the holding coil produce sufficient ampere-turns to hold the armature in the operated position.

When these coils are deenergized, a substantial amount of energy is released. This transient energy may cause malfunctions and/or damage to other relays on the same circuit or to the relay itself.

In the past, external devices, such as diodes, thyristors or capacitors, were used to supress these transients. Such components are subject to possible failure, which may even be caused by the momentary application of the wrong polarity of voltage across these devices. Even more serious and of even greater concern in the protective relaying field, and particularly as protective relays may be utilized in the protection of public utility electrical circuits, failures may not be evident until it is too late to make repairs, resulting in substantial damage to the electrical circuits of public utilities. External devices which require additional soldered joints in the relay to connect the external devices were always subject to the problems of possible cold solder joints or failure due to overheating. External components may also represent substantial additional cost in particular cases depending on the particular external device chosen to reduce the transients. The present invention eliminates electrical transients in relays in an efficient manner which obviates the need for external devices and eliminates their potential for detected and undetected failures. The present invention eliminates additional soldered connections and it reduces cost and is a reliable means of reducing transients in DC relays using a reliable method. The structure is built into the structure of the relay coil form and shield.

SUMMARY OF THE INVENTION

The present invention is that it provides a method and apparatus of reducing electrical transients in relay coils without substantial slowing of the operation of the relay. In accordance with the present invention, a flat or pancake holding coil is provided which is axially spaced from the operating coil, and is provided with a conductive shield juxtaposed thereto. Optionally, the operating coil may also be provided with a conductive shield juxtaposed thereto.

An advantage of the present invention is that electrical transients caused by operation of the relay may be reduced without the use of additional components which are subject to failure both by reason of component failure and defects in the soldered joints, such as cold soldered joints or joints which have failed due to overheating.

Another advantage of the present invention is that the energy produced by the change in flux with respect to time that occurs when the relay is deenergized is dissipated by eddy currents in the conductive shield thereby absorbing much of this transient energy and reducing transient peak voltages.

Another advantage of the present invention is that it has a distributed capacitance between the shield and the coil thereby spreading the transient voltages among the turns. This lessens the transient voltage build-up on the end turns and reduces the transient voltages between turns.

The capacitance effect of the shield has a similar beneficial effect on externally generated transients which may enter the relay coils, such as those caused by lightning, switching or induced surges.

Briefly, in accordance with the method of the present invention, a method is provided of reducing transients in a relay provided with an operating coil and a holding coil. The method includes the step of providing or forming the holding coil in the form of a substantially flat coil, which is mounted in axial alignment with the operating coil. It further includes the step of providing a conductive shield in close proximity to at least the flat holding coil with the conductive shield juxtaposed over a substantial portion of one flat surface of the coil and a substantial portion of the peripheral edge of the flat holding coil.

Briefly, in accordance with the apparatus of the present invention, a relay is provided which includes a relay coil structure adapted to reduce electrical transients therein. The relay is provided with an operating coil mounted on a coil form of the relay. A holding coil is mounted on the coil form and axially spaced from the operating coil. The holding coil is constructed to be a flat or pancake coil. A conductive shield is mounted in close proximity to and juxtaposed over a substantial portion of one flat surface of the flat pancake holding coil. The conductive shield extends over a substantial portion of the outer peripheral edge of the pancake coil.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

DETAILED DESCRIPTION OF THE PREFERRED EMBODIMENTS

Figure 1:
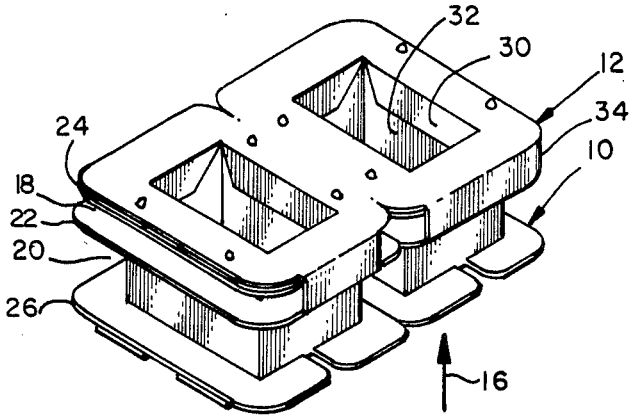
FIG. 1 is a view in perspective of a relay coil form and holding coil conductive shield in accordance with the present invention.
Figure 2:
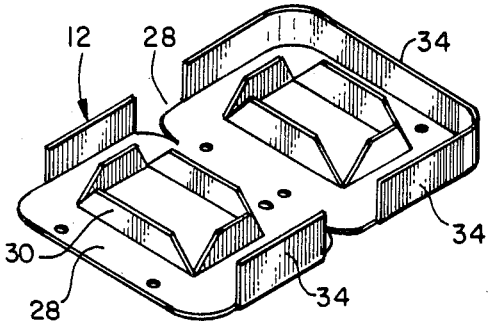
FIG. 2 is a view in perspective of a conductive shield in accordance with the present invention.
Figure 3:
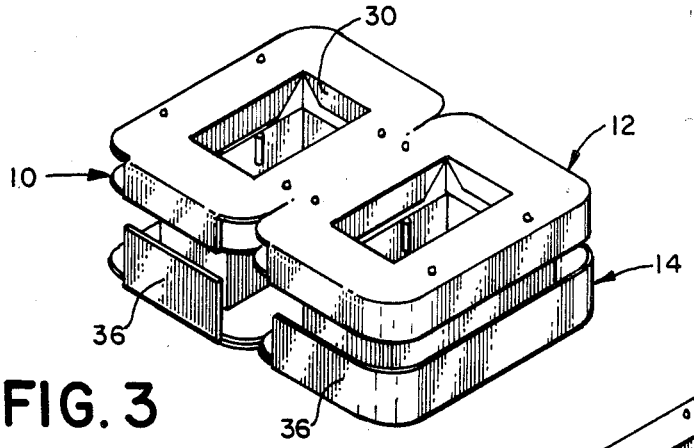
FIG. 3 is a view in perspective from the opposite end of that shown in FIG. 1 with conductive shields provided for both the holding coil and the operating coil.

Referring now to the drawings, wherein like numerals indicate like elements, there is shown in FIG. 1 a relay coil form 10 provided with a conductive shield 12. A more detailed view of conductive shield 12, from the underside thereof, is shown in FIG. 2. Relay coil form 10 with conductive shield 12 is shown in FIG. 3 from the other side as compared to that shown in FIG. 1. Conductive shield 12 is provided for the holding coil of the relay. FIG. 3 also illustrates the use of a conductive shield 14 which may be utilized in conjunction with the operating coil.

Figure 4:
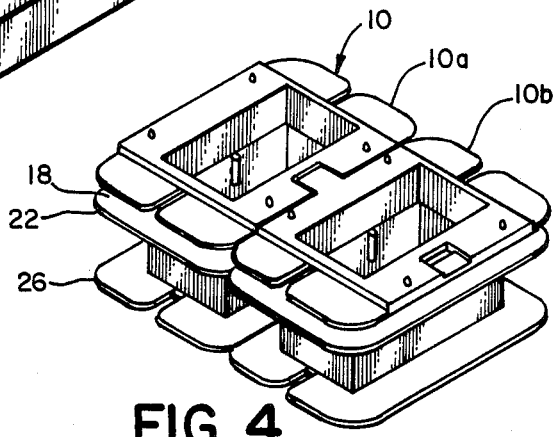
FIG. 4 is a view in perspective of a relay coil form in accordance with the present invention.
Figure 5:
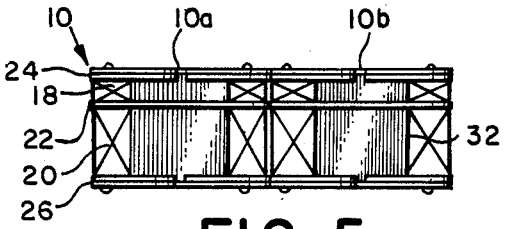
FIG. 5 is an elevation view of the relay coil form of FIG. 4 in accordance with the present invention.

FIG. 4 is a view in perspective of a relay coil form 10 in accordance with the present invention without a conductive shield. FIG. 5 is an elevation view of relay coil form 10 shown in FIG. 4. Reference may be had to all five figures in connection with the following description.

As referred to above, relays and particularly DC relays typically are provided with an operating (pick-up) coil and a holding (economizing) coil to provide, respectively, efficient operation of the armature and then efficient maintenance of the armature in the operated position. These relay coils have been customarily constructed in the past by the winding of the holding coil turns concentrically over the operating coil turns. The holding coil conventionally has a large number of turns of fine gauge wire.

In accordance with the present invention, the holding coil and operating coil are wound on a specially designed relay coil form 10. The holding coil and the operating coil are positioned axially with respect to each other. Arrow 16 in FIG. 1 illustrates the axial direction. The windings of the holding coil and the windings of the operating coil are not illustrated for the purposes of clarity. The holding coil windings would be wound in space 18. The operating coil windings would be wound in space 20 of relay coil form 10. The holding coil is wound in holding coil space of relay coil form 10 to form a flat coil, which is sometimes referred to in the art as a "pancake" coil. The holding coil 18 is insulated from the operating coil by means of spacer 22 of relay coil form 10. The holding coil 18 is therefore mounted on relay coil form 10 axially spaced from the operating coil. In other words, holding coil 18 is wound on relay coil form 10 between elements 22 and 24. The operating coil is wound between elements 22 and 26. The relay coil form 10 including elements 22, 24 and 26 are preferably molded from an insulative plastic (synthetic) material. In a preferred embodiment, as illustrated in FIG. 4, relay coil form 10 is preferably molded in two separate identical units 10A and 10B and subsequently snapped together for the purposes of simplifying the manufacturing process and reducing the cost thereof. However, it is understood that other methods and means may be utilized to form the axially mounted pancake holding coil to provide the benefits of the present invention.

The conductive shield 12 is preferably mounted in juxtaposition to the holding coil since the holding coil has a significantly larger number of turns than the operating coil and therefore produces significantly more transients upon energization. However, a conductive shield 14 may be utilized in conjunction with the operating coil in addition to the conductive shield 12 utilized in conjunction with the holding coil. Both conductive shields 12 and 14 are comprised of a conductive material and are preferably thin, formed, copper plates which are placed on the flat surface of the coils of the relay and have their edges folded down on the inside of each coil and on the outside or periphery of each coil. The coils may be preferably formed from copper plate on the order of one millimeter of thickness. However, it is understood that the essential element of the present invention is to provide a conductive shield mounted in close proximity to a substantial portion of the surface of the coil, and the specific preferred embodiments disclosed herein, such as the use of copper plate and the suggested thickness are not to be construed as limiting the scope of the present invention. It it understood that other conductive materials may be utilized to form the conductive shields and other thicknesses of such conductive material may be utilized in practicing the present invention.

Referring to FIG. 2, there is shown conductive shield 12 formed of a conductive plate material with portions 28 adapted to be mounted in close proximity to the flat holding coil and juxtaposed over a substantial portion of the flat surface of the coil with insulating element 24 therebetween. Edges 30 are folded down inside the center space of each coil with the insulative core 32 of relay coil form 10 therebetween. The outer edges of conductive shield 12 are folded down as flaps 34 over the periphery of the holding coil. In a similar manner, conductive shield 14 is provided with folded outer edges 36 which extend over the periphery of the operating coil and folded inner edges or flaps (not shown).

The change in flux that occurs when the relay coil is deenergized creates eddy currents in the shields 12 and 14. The eddy currents in the shields absorb much of the transient energy and thereby reduce the transient peak voltages.

Furthermore, the shields 12 and 14 and the flat or pancake coil structure produces a distributed capacitance between the shields and the coils which spreads the transient voltages among the turns. This lessens the transient voltage buildup on the end turns and reduces the transient voltages between turns. The shields 12 and 14 have a similar beneficial effect on externally generated transients which may enter the relay coils, such as those caused by lightning, switching or other induced surges.

The capacitance between the shields 12 and 14 and the coils, and the energy absorbed by eddy currents in the shields, both depend upon the shields being as close to the coils as possible, and to encompass as much of the coils as practical.

The amount of transient energy released when a relay coil is deenergized depends largely upon the ampere-turns. The holding coil contains a substantially greater number of turns than the operating coil. Therefore, the holding coil will create the majority of the transients. Therefore, it is substantially more important to have a conductive shield in close proximity to the holding coil, juxtaposed over one surface of this coil and over a substantial portion of the periphery of this coil. Although it is of some benefit to also provide conductive shield 14 in close proximity to the operating coil, this is substantially less significant because of its smaller number of turns. The present invention enables the shielding and capacitance effect by the forming of a flat holding coil positioned axially with respect to the operating coil thereby enabling the shielding to be in close proximity to the coil and arranged in such a manner to provide a distributed capacitance effect.

Although the providing of conductive shield 14 on the operating coil, in addition to conductive shield 12 on the holding coil, is of lesser importance than conductive shield 12, operating coil conductor shield 14 does increase the capacitance between the turns to better protect the operating coil against incoming transients and absorbs some of the transient energy released when the operating coil is deenergized.

The present invention may be embodied in other specific forms without departing from the spirit or essential attributes thereof and, accordingly, reference should be made to the appended claims, rather than to the foregoing specification as indicating the scope of the invention.

I claim:

1. A method of reducing transients in a direct current relay provided with a direct current operating coil and a direct current holding coil, comprising the steps of:

providing said direct current holding coil in the form of a substantially flat coil mounted in axial alignment with said direct current operating coil; and providing a non-magnetic conductive shield in close proximity to at least said flat holding coil and juxtaposed over substantial portions of one flat surface of said coil and a substantial portion of the peripheral surface of said flat holding coil.

2. A method of reducing transients in a direct current relay in accordance with claim 1 including the step of providing a conductive shield in close proximity to said operating coil and juxtaposed over a substantial portion of the periphery of said direct current operating coil, and spaced from said conductive shield of said flat coil.

3. A method of reducing transients in a direct current relay in accordance with claim 1, including the step of providing a conductive shield made of copper.

4. A method of reducing transients in a direct current relay in accordance with claim 1 including the step of providing a conductive shield which extends through a predetermined degree within the center of said flat holding coil.

5. A relay including a direct current relay coil adapted to reduce electrical transients therein, comprising:

a direct current operating coil mounted on a coil form of said relay;

a direct current holding coil mounted on said coil form axially spaced from said direct current operating coil, said holding coil being a direct current flat pancake coil; and a non-magnetic conductive shield mounted in close proximity to and juxtaposed over a substantial portion of one flat surface of said direct current flat pancake coil, and said shield extending over a substantial portion of the outer peripheral edge of said direct current pancake coil.

6. A direct current relay coil adapted to reduce electrical transients in accordance with claim 5 including a conductive shield mounted in close proximity to and juxtaposed over a substantial portion of said direct current operating coil.

7. A direct current relay coil adapted to reduce electrical transients in accordance with claim 5 wherein said conductive shield is made of copper.

8. A direct current relay coil adapted to reduce electrical transients in accordance with claim 5 wherein said conductive shield extends to a predetermined degree within the center of said direct current flat pancake coil.

9. A method of reducing transients in a direct current relay in accordance with claim 2 including the step of inducing eddy currents in said conductive shield in close proximity to said operating coil and causing the dissipation of said eddy currents in the resistance of said shield whereby contact bounce in the relay may be reduced.

10. A direct current relay coil adapted to reduce electrical transients in accordance with claim 6 wherein said conductive shield mounted in close proximity to and justaposed over a substantial portion of said direct current operating coil is provided with a predetermined resistance to dissipate eddy currents induced therein and to thereby reduce contact bounce in the direct current relay.

11. A method of reducing transients in a relay in accordance with claim 1, wherein said shield is not connected to ground with respect to said coil.

12. A relay coil adapted to reduce electrical transients in accordance with claim 5, wherein the shield is not connected to ground with respect to said coil.

* * * * *